US008342328B2

(12) United States Patent
Trapp et al.

(10) Patent No.: US 8,342,328 B2
(45) **Date of Patent: *Jan. 1, 2013**

(54) PRODUCT PACKAGING WITH RELEASABLE FASTENER

(75) Inventors: Timothy J. Trapp, Orchard Park, NY (US); Robert Michael Buresch, Strykersville, NY (US); Donald George Scheffold, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/906,413

(22) Filed: Oct. 18, 2010

(65) Prior Publication Data

US 2012/0006713 A1 Jan. 12, 2012

Related U.S. Application Data

(63) Continuation of application No. 12/249,235, filed on Oct. 10, 2008, now abandoned.

(51) Int. Cl.
*B65D 73/00* (2006.01)

(52) U.S. Cl. ..... 206/480; 206/477; 206/493; 411/552; 24/458; 24/453

(58) Field of Classification Search ..... 206/764, 206/765, 335, 477, 493, 480; 411/349, 543, 411/549, 552; 24/663, 297, 458, 453
See application file for complete search history.

(56) References Cited

U.S. PATENT DOCUMENTS

| | | | |
|---|---|---|---|
| 2,191,780 | A | 2/1940 | Tinnerman |
| 2,620,539 | A | 12/1952 | Poupitch |
| 3,121,273 | A | 2/1964 | Duffy et al. |
| 3,335,471 | A | 8/1967 | Seckerson et al. |
| D209,171 | S | 11/1967 | Myatt |
| 3,407,454 | A | 10/1968 | Myatt |
| 3,449,799 | A | 6/1969 | Bien |
| 3,674,138 | A | 7/1972 | Gilmour |
| 3,811,565 | A | 5/1974 | Tancredi |

(Continued)

FOREIGN PATENT DOCUMENTS

FR 2233243 1/1975

(Continued)

OTHER PUBLICATIONS

Search Report for International Patent Appln. PCT/US2009/059925 dated Nov. 25, 2009.

*Primary Examiner* — David Fidei
(74) *Attorney, Agent, or Firm* — Edell, Shapiro & Finnan, LLC

(57) ABSTRACT

A fastener system includes a toy product, a support platform, and a plug that engages a keyhole formed into the product. The plug includes a base and a pronged key extending from the base. The support platform includes a through-hole that permits the passage of the key into the packaging. One or more integrally-formed biasing members are located on the base of the plug to draw the key toward the product and create a secure connection. The pronged key may be formed from a plastic material and configured such that it plastically deforms but remains attached to the key when and predetermined force is applied to the key to pull the key from a misaligned position with respect to the key hole.

20 Claims, 7 Drawing Sheets

U.S. PATENT DOCUMENTS

| | | | | |
|---|---|---|---|---|
| 3,815,182 | A | 6/1974 | Guard et al. | |
| 3,816,882 | A | 6/1974 | Maeda et al. | |
| 3,963,123 | A | 6/1976 | Beal | |
| 3,990,131 | A | 11/1976 | Okamura | |
| 4,117,928 | A | 10/1978 | Schenk | |
| 4,185,739 | A | 1/1980 | Wilford | |
| 4,262,394 | A | 4/1981 | Wright | |
| 4,285,103 | A | 8/1981 | Inamoto | |
| 4,470,178 | A | 9/1984 | Matsui | |
| 4,524,494 | A | 6/1985 | Sato et al. | |
| 4,657,462 | A | 4/1987 | Hoen | |
| 4,682,690 | A | 7/1987 | Tiffany | |
| 4,865,097 | A | 9/1989 | Allen | |
| 5,018,253 | A | 5/1991 | Oppenheimer | |
| 5,289,916 | A | 3/1994 | Mickelberg | |
| 5,368,427 | A | 11/1994 | Pfaffinger | |
| 5,411,138 | A | 5/1995 | Klawiter | |
| 5,501,330 | A | 3/1996 | Betts | |
| 5,896,991 | A | 4/1999 | Hippely et al. | |
| 5,897,278 | A | 4/1999 | Frattarola | |
| 6,237,970 | B1 | 5/2001 | Joannou | |
| 6,425,482 | B1 | 7/2002 | Chiang | |
| 6,575,682 | B1 | 6/2003 | Dohm et al. | |
| 6,735,819 | B2 | 5/2004 | Iverson et al. | |
| 6,769,853 | B2 | 8/2004 | Perrot | |
| 6,988,863 | B2 | 1/2006 | Hulin et al. | |
| 7,328,489 | B2 | 2/2008 | Leverger | |
| 7,955,038 | B2 * | 6/2011 | Silbereisen et al. | 411/552 |
| 2005/0269235 | A1 | 12/2005 | Lam | |
| 2010/0089787 | A1 * | 4/2010 | Trapp | 206/477 |
| 2010/0089788 | A1 * | 4/2010 | Trapp | 206/493 |
| 2010/0272540 | A1 * | 10/2010 | Bucker et al. | 411/549 |
| 2011/0253579 | A1 * | 10/2011 | Chong et al. | 206/493 |

FOREIGN PATENT DOCUMENTS

| | | | |
|---|---|---|---|
| GB | 1137395 | | 12/1968 |
| GB | 2201826 | A | 9/1988 |

* cited by examiner

PRODUCT PACKAGING WITH RELEASABLE FASTENER

CROSS REFERENCE TO RELATED APPLICATIONS

This application is a continuation of U.S. Non-provisional application Ser. No. 12/249,235, entitled "Product Packaging with Releasable Fastener" and filed on 10 Oct. 2008, the disclosure of which is hereby incorporated by reference in its entirety.

FIELD OF THE INVENTION

The present invention is directed toward product packaging and, in particular, to toy product packing including a releasable, reusable product fastener.

BACKGROUND OF THE INVENTION

Products such as toys are generally placed in packaging that provides protection to the toy, as well as and provides a means to easily display the toy. The toys are often held in the packaging by wire tie elements, which surround the toy and are twisted together to hold the toy in place in the packaging. This design works for small toys; however, large toys require a significant amount of wire and, because of the shape of the toys, it may not be practical to place the wire around the toy to retain it in its packaging. In addition, removal of such a large amount and number of wire tie elements is tedious and time-consuming. Thus, it is desirable to create a fastening system that secures a product within its packaging, but is easily manipulated by a user to remove the product therefrom.

SUMMARY OF THE INVENTION

A fastener system for product packaging is disclosed. The system includes a product, a support platform, and a plug that engages a keyhole formed into the product. The plug includes a base and a key extending from the base. The support platform includes a through-hole that permits the passage of the key into the packaging. In operation, a product is oriented on one side of the support platform, and the plug is oriented on an opposite side of the support platform. The key is inserted though the packaging (via the through-hole), and into the keyhole formed in the product. The key is then rotated to misalign its fingers with the openings in the keyhole, preventing the key's exit from the keyhole. Biasing members located on the base of the plug draw the key toward the product to create a secure connection. With this configuration, a product may be secured within packaging without the use of wire tie fasteners.

BRIEF DESCRIPTION OF THE DRAWINGS

FIG. 2A illustrates an isolated, top perspective view of a plug component of the fastening system in accordance with an embodiment of the present invention. FIG. 2B illustrates a bottom perspective view of the plug of FIG. 2A.

FIG. 4A illustrates a side view of the product wall, while FIG. 4B illustrates an interior view of the product wall of FIG. 4A.

Like reference numerals have been used to identify like elements throughout this disclosure.

DETAILED DESCRIPTION OF THE INVENTION

Figure 1:
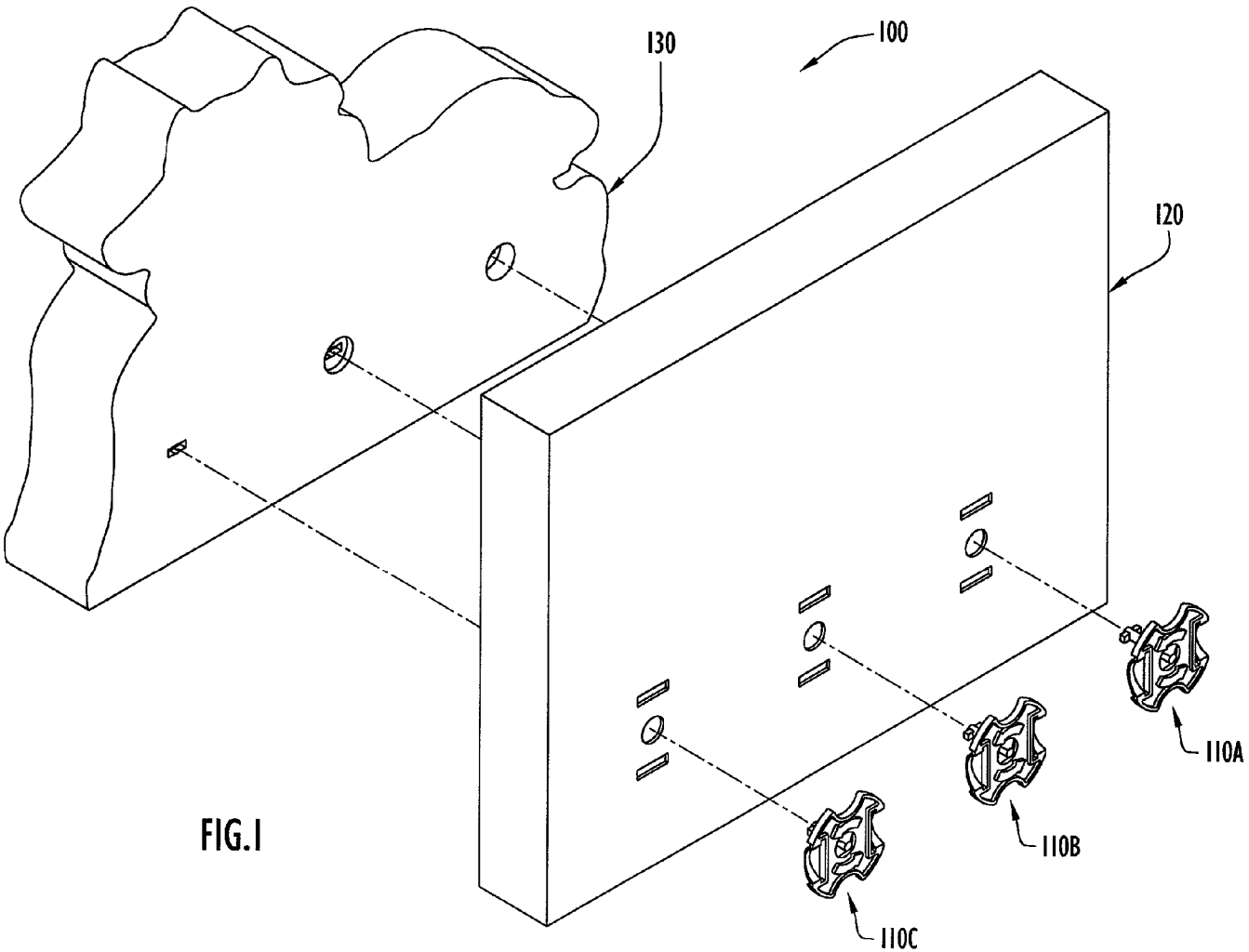
FIG. 1 illustrates an exploded view of a product fastening system in accordance with an embodiment of the present invention.
Figure 2A:
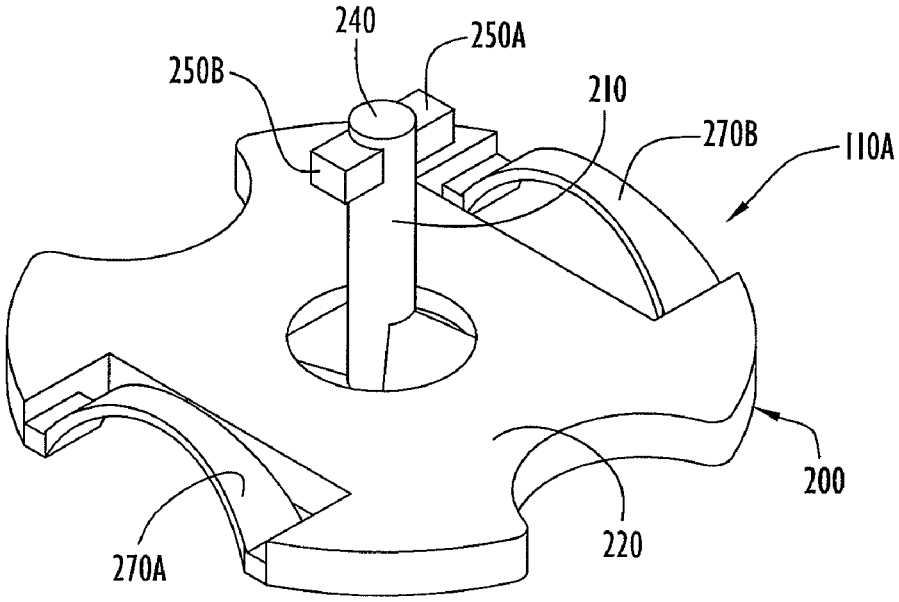
FIGS. 2A and 2B illustrate a plug in accordance with embodiments of the present invention. Specifically.
Figure 2B:
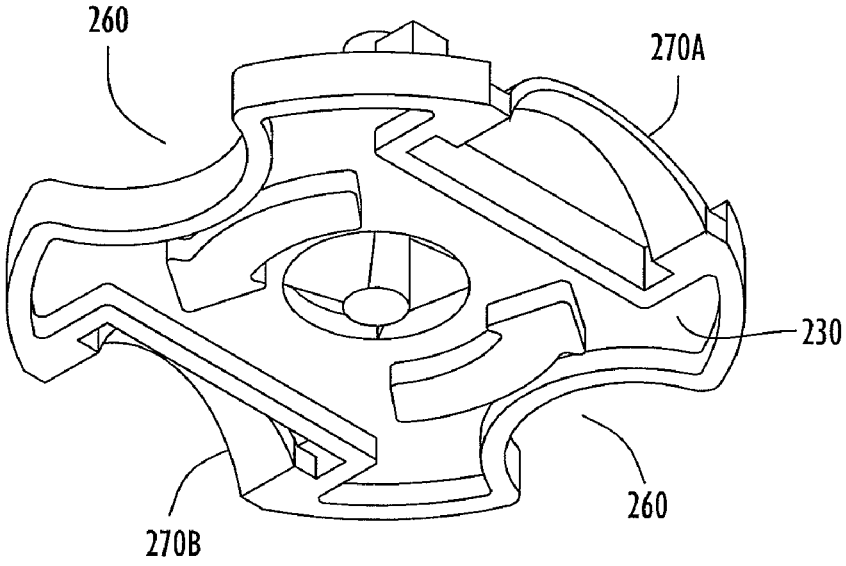

FIG. 1 illustrates and exploded view of a product fastening system in accordance with an embodiment of the invention. As illustrated, the system 100 includes a key or plug, a product support or platform 120, and a product 130. By way of example the system 100 may include one or more plugs 110A, 110B, 110C, each having a stem of a predetermined length. The plugs 110A-110C are configured to selectively secure the product 130 to the product support 120. Referring to FIGS. 2A and 2B (showing top and bottom views, respectively), the plug 110A includes a base 200 and a shaft or stem 210 extending distally from the base 200. The base 200 may be in the form of a plate or disk having a first or top surface 220 and a second or bottom surface 230. The shaft 210 may be disposed coaxially with the central axis of the base 200. The distal end 240 of the shaft may further include a first finger 250A and a second finger 250B collectively defining a keyed end of the shaft 210. The base 200 may further include one or more cut-out sections 260 configured to permit gripping of the base utilizing a users fingers. By way of example, the base 200 may include a pair of opposed, curved, cut-out sections 260 formed into the periphery of the base.

The plug 110A may further include one or more biasing members. In the embodiment of FIGS. 2A and 2B, the plug 110A may have a first spring 270A and a second spring 270B formed into the base 200. The springs 270A, 270B may be positioned along the base periphery such that the first spring 270A is oriented opposite the second spring 270B. The biasing members 270A, 270B apply a force to the product support 120 and/or the product 130 to increase the tension between the plug 110A-C and the product 130 (discussed in greater detail below). While a particular configuration spring is illustrated as the biasing member 270A, 270B, it should be understood other forms of the biasing member could be utilized such as a flat springs, coil springs, cantilevered springs, leaf springs, etc.

Figure 3:
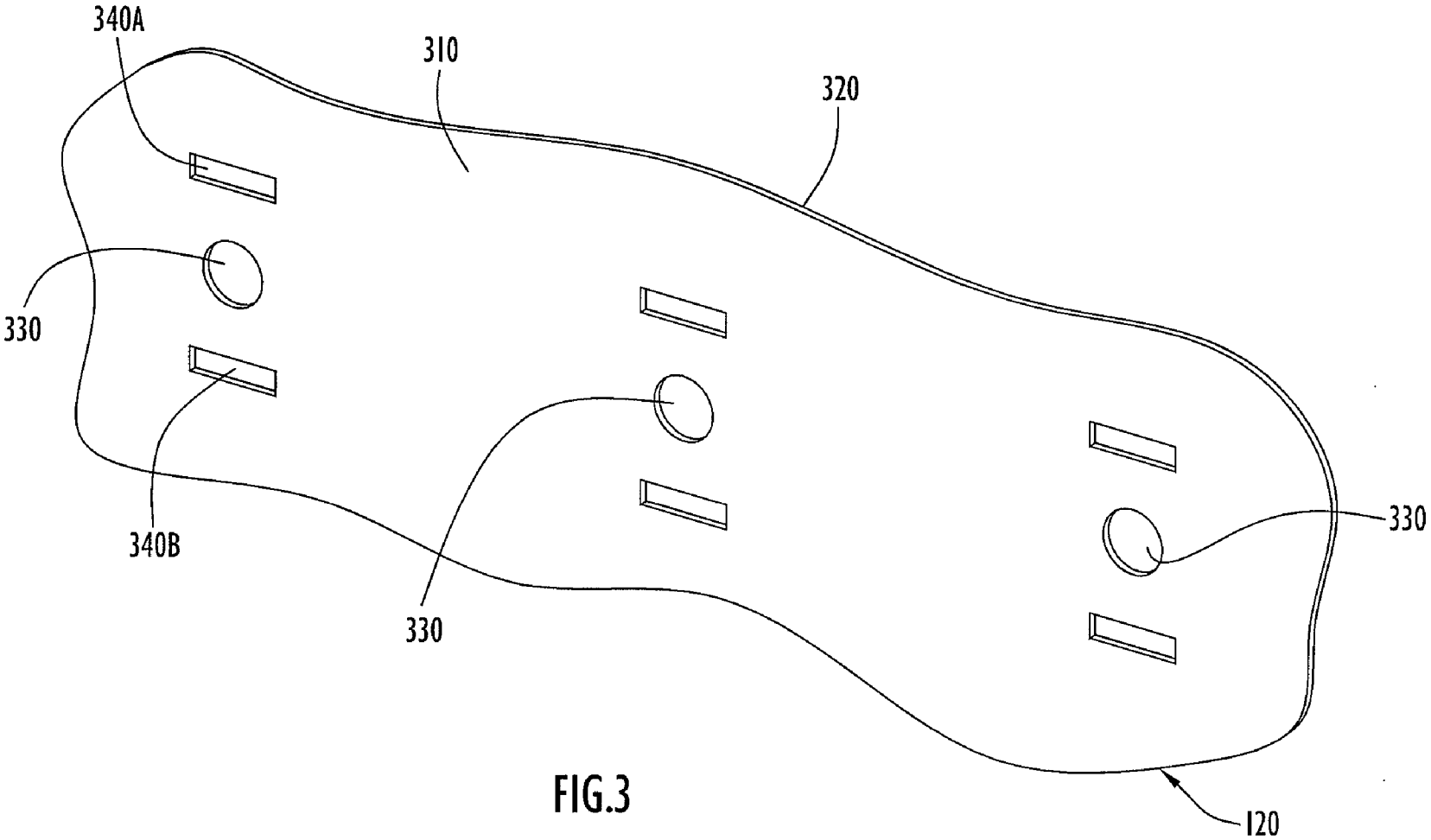
FIG. 3 illustrates a support platform in isolation, showing a close-up of the through-holes.

The product support or platform 120 provides a surface to which the product 130 may be secured. The product support 120 typically comprises a portion of product packaging, e.g., a wall or a display platform, to which the product 130 is secured. Referring to FIG. 3, the product platform 120 may be a generally planar element having a first or outer surface 310 and a second or inner surface 320. The planar member may include one or more key ports 330 configured to receive the keyed end of a respective plug 110A-110C. That is, the key port 330 possesses a shape and has dimensions suitable to permit the passage of the distal/keyed end 240 of the plug shaft 210, while preventing the passage of the base 200 therethrough. As illustrated, the port 330 may possess a generally circular shape having a diameter slightly larger than the diameter of the fingers 250A, 250B, to permit the fingers to pass therethrough.

The product support 120 may further include one or more receptacles or guide tracks configured to receive and/or orient the biasing members 270A, 270B on the plug 110A-C. By way of example, the product support 120 may include a first guide track 340A and a second guide track 340B oriented opposite the first guide track 340A, across the port 330 (i.e., each biasing member 270A, 270B may include an associate track 340A, 340B with which it mates). The structure of the guide track 340A, 340B may be any suitable for its described purpose. In the illustrated embodiment, the guide tracks 340A, 340B are each defined by a generally rectangular opening that permits a biasing member 270A, 270B to extend through or into the platform 120. Each guide track 340A, 340B is positioned and sized to receive a corresponding biasing member 270A, 270B, indicating the orientation of the plug 110A-C in either a locked or unlocked position (discussed in greater detail below). The product support 120 may be formed from any conventional packaging materials including, but not limited to, plastic, cardboard, wood, etc.

Figure 4A:
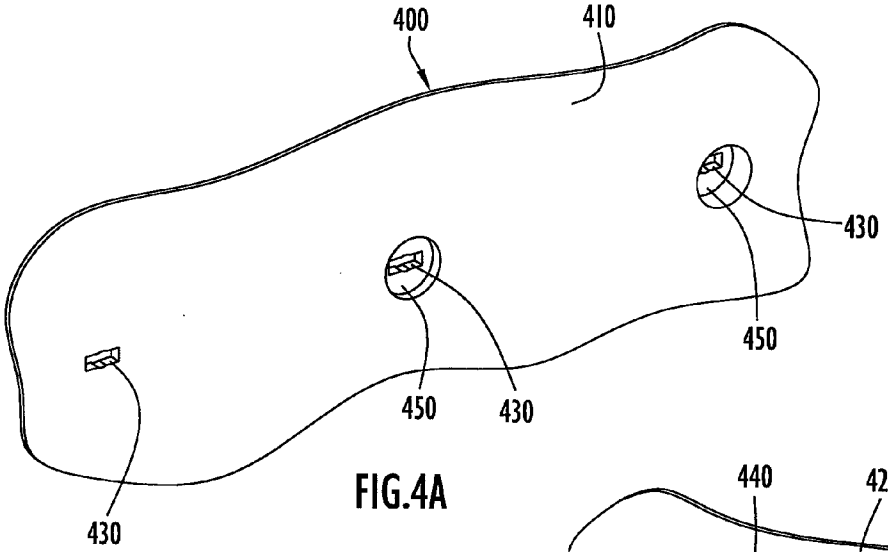
FIGS. 4A and 4B illustrate a portion of a wall forming the product if FIG. 1. Specifically.
Figure 4B:
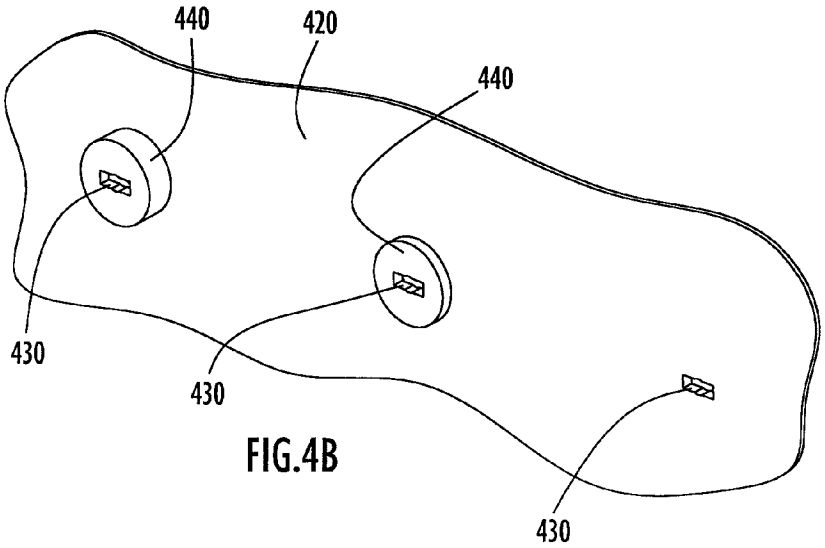

The product 130, e.g., a toy, is configured to selectively mate with the plugs 110A-C. Referring to FIGS. 4A and 4B, showing exterior and interior views the product 130, the product 130 includes a wall 400 having a first or exterior side 410 and a second or interior side 420. The wall 400 includes one or more keyholes 430 possessing a shape complimentary to that of the distal end 240 of each of the plugs 110A-C. In the embodiment illustrated in FIGS. 4A and 4B, the keyhole 430 is a generally elongated slot that receives the fingers 250A, 250B of the plug 110A-C when properly aligned with the slot. The keyhole 430 may be formed on a pedestal 440 extending distally from the interior surface 420 of the product wall 400.

The pedestal 440 may form a corresponding recessed area 450 along the exterior surface 410 of the product wall 400. The height of the pedestal 440 is not particularly limited, but is typically is sized to correspond with the length of the stem 210 extending form the base 200 of the plug (taking into account the thickness of the product wall 400 as well as the product support 130). By way of example, the pedestal 440 may have a height corresponding to the stem of plug 110A, or may have a height corresponding to the stem of plug 110B (FIG. 1). Alternatively or addition, no pedestal 440 may be formed into the product wall 400 to permit the keyhole 430 to be generally flush with the product wall 400. Note that for exemplary purposes, all three examples are shown in FIGS. 1, 4A, and 4B.

Figure 5A:
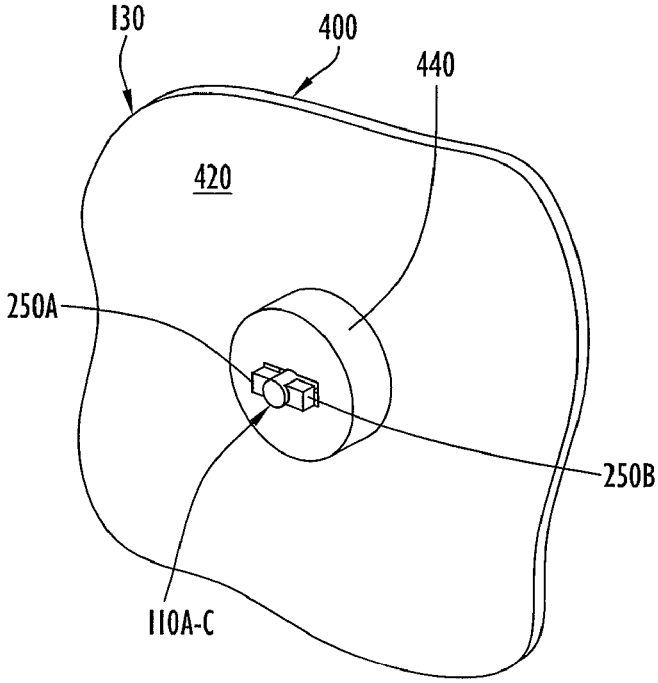
FIG. 5A illustrates an interior view of the product, showing the plug/key oriented in an unlocked position.
Figure 5B:
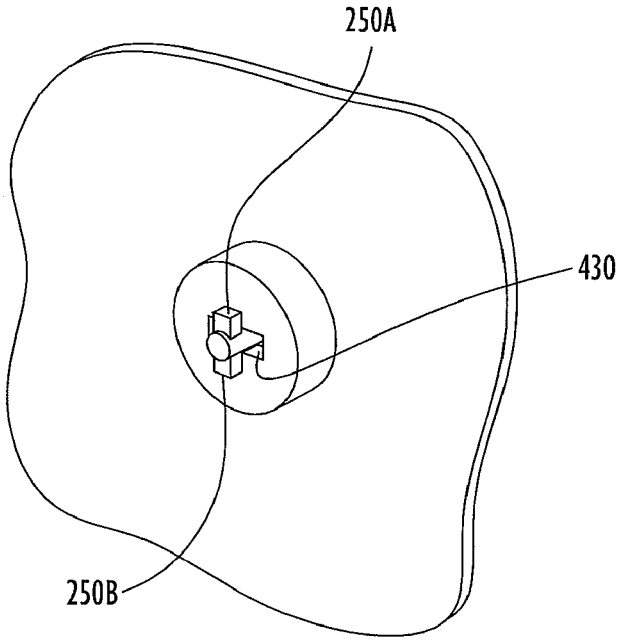
FIG. 5B illustrates an interior view of the product, showing the plug/key oriented in a locked position.

With this configuration, plug 110A-C selectively engages the keyhole 430 to secure the product 130 to the support 120. Referring to FIGS. 5A and 5B, the stem 210 of the plug 110A-C may be axially inserted into the port 330 of product support 120 and through the keyhole 430 formed in product 130. The plug 110A-C may then be selectively rotated from a first (unlocked) position (FIG. 5A), in which the fingers 250A, 250B of the plug generally align with the keyhole 430, to a second (locked) position (FIG. 5B), in which the fingers 250A, 250B of the plug 110A-C are not aligned with the keyhole 430. In the locked position of FIG. 5B, the plug 110A-C is secured to the product 130. To unlock the plug 110A-C and remove it from the keyhole 430, the plug 110A-C is simply rotated in the reverse direction until the fingers 250A, 250B of the plug 110A-C once again align with the slot of keyhole 430. The stem 210 of the plug 110A-C is then axially removed from the product 130.

The operation of a fastening system in accordance with the present invention is explained with reference to FIGS. 6A and 6B. FIG. 6A illustrates a cross-sectional view of the system in accordance with an embodiment of the invention. The product 130 is positioned on the second side 320 of the support platform 120, and the plug 110A-C is positioned on the first side 310 of the support platform. The port 330 of the support platform 120 is generally aligned with a keyhole 430 of the product 130, and the plug 110A-C is axially inserted through the port 330 of the support platform 120 and into the keyhole 430 of the product 130. The plug 110A-C may then be rotated to move the plug 110A-C (by gripping the cut-out sections 260) from the unlocked position to the locked position as described above.

Figure 6B:
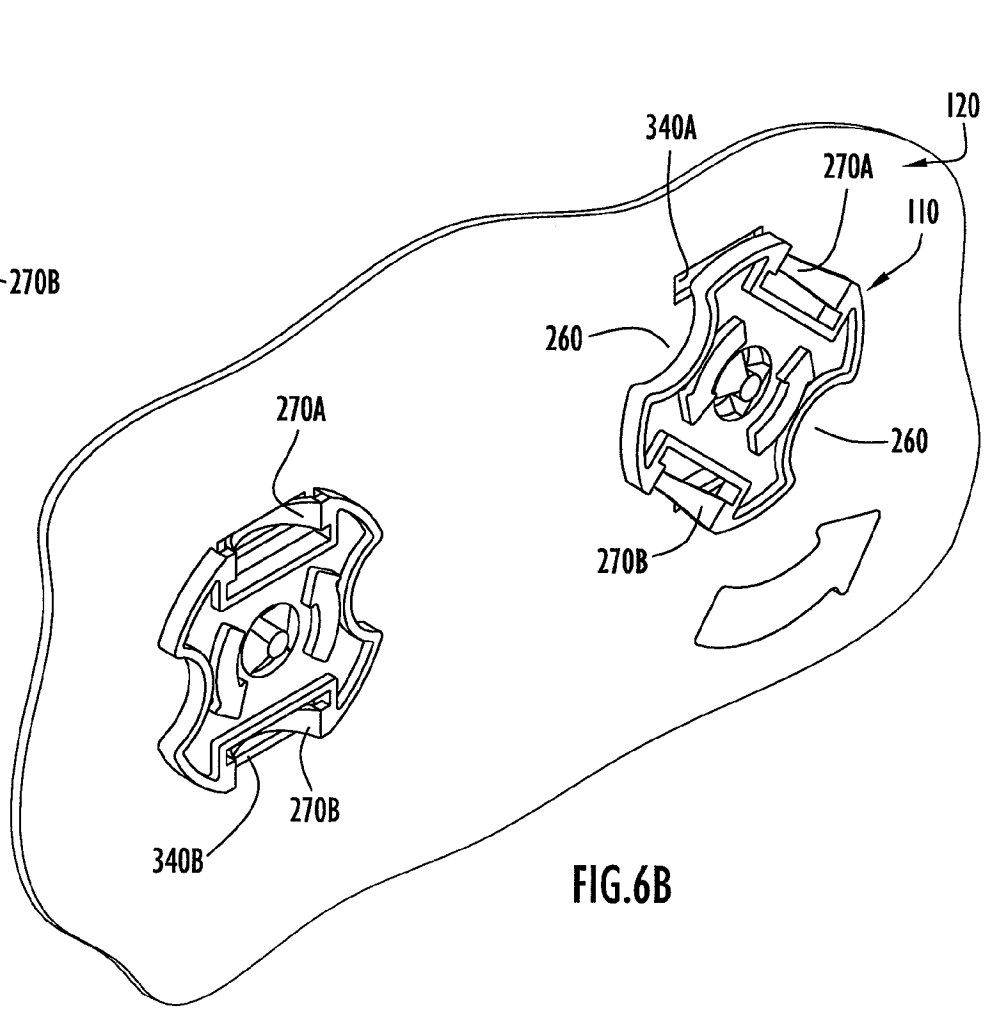
FIG. 6B illustrates a rear perspective view of the support platform, showing orientation of the plug in locked/unlocked positions.
Figure 6A:
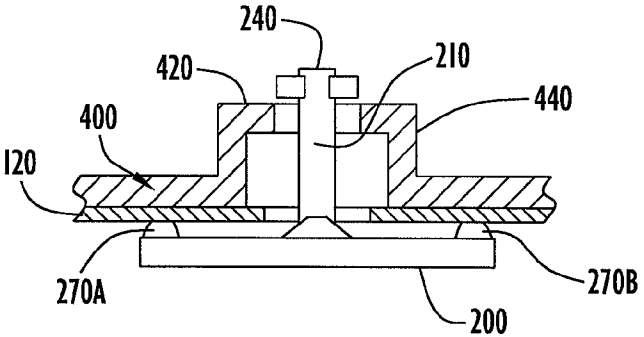
FIG. 6A illustrates a cross-sectional view of the product, showing the insertion of the key into the keyhole of the product.

Referring to FIG. 6B, illustrating a rear perspective view of the system, the plug 110A-C may be rotated utilizing finger cut-out sections 260 until the biasing members 270A, 270B align with the guide tracks 340A, 340B formed into the product support 120. The biasing members 270A, 270B and guide tracks 340A, 340B may be oriented such that mating of the biasing members with the guide tracks indicates the fingers 250A, 250B of the plug 110 are oriented in their misaligned/locked position with respect to the keyhole 430 of the product 130. The biasing members 270A, 270B apply a downward pressure (from the perspective of FIG. 6A) to the plug stem 210, drawing the distal end 240 of the stem downward, toward the interior surface 420 of the product wall 400. This, in turn, increases the frictional forces between the fingers of the plug 110A-C and the product 130, improving the connection of the product 130 to the product support 120. The biasing members 270A, 270B further function as shock absorbers, adjusting to movement of the packaging during transport and stabilizing the product 130.

To release the product 130 from the product support 120, the plug 110 is rotated to displace the biasing members 270A, 270B from the guide tracks 340A, 340B until the fingers 250A, 250B are once again axially aligned with the keyhole 430 of the product 130 as described above. The plug 110A-C may then removed from the product 130, which, in turn, may be removed from the support platform 120.

Figure 7A:
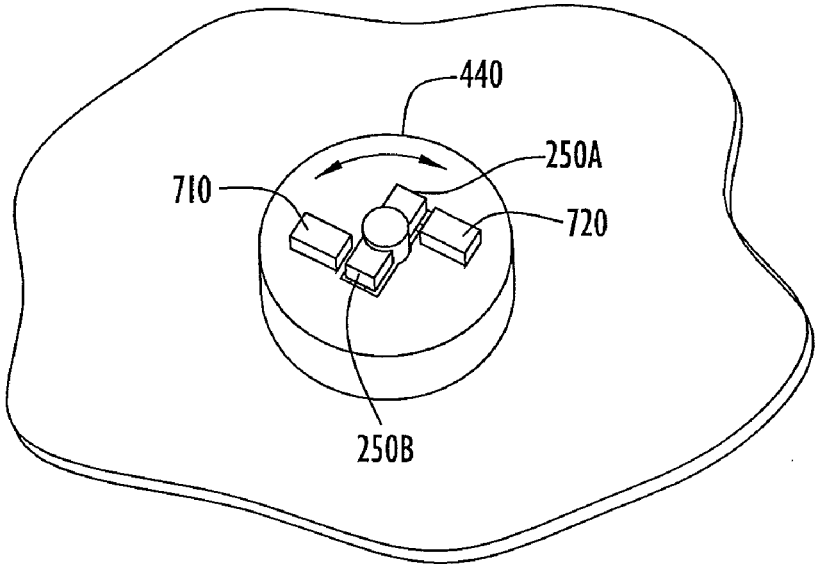
FIG. 7 illustrates a plug/key in accordance with another embodiment of the present invention.
Figure 7B:
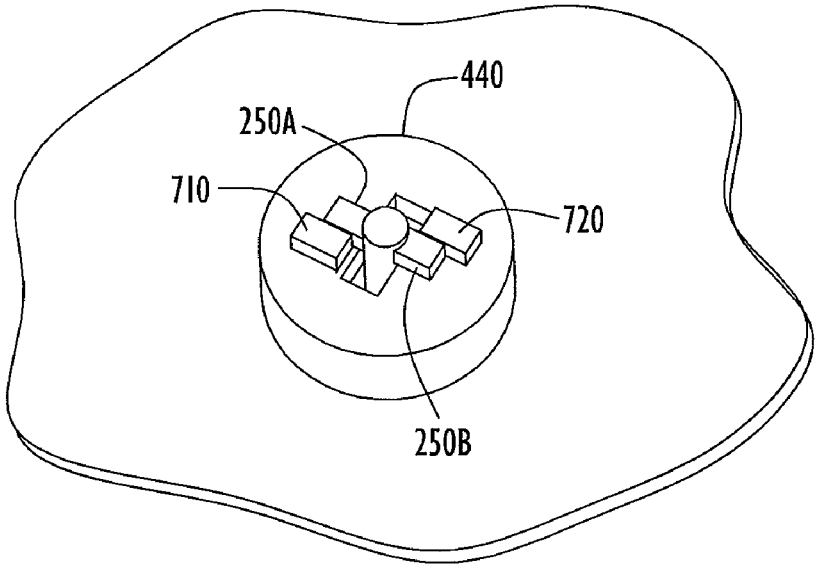

FIGS. 7A and 7B illustrate a fastening system in accordance with another embodiment of the present invention. As illustrated, the pedestal 440 may include one or more stops to prevent over rotation of the plug 110A-C, as well as to signal to the user that the plug 110A-C is in its locked position. Referring to FIG. 7A, the pedestal 440 may include a first boss 710 and a second boss 720 opposed from the first boss across the keyhole 430. In operation, as shown in FIG. 7B, the plug 110A-C may be inserted into the keyhole 430 and rotated until the fingers 250A, 250B of the plug 110A-C contact the bosses 710, 720. The bosses 710, 720, then, prevent over rotation of the plug 110A-C.

The shaft 210 and fingers 250A, 250B of the plug 110A-C may also configured to prevent the formation of small parts. A "small part" is any object that fits completely into a specially designed test cylinder (2.25 inches long by 1.25 inches wide) that approximates the size of the fully expanded throat of a child under three years old. This specialized definition applies to (1) a whole toy or article, (2) a separate part of a toy, game, or other article, or (3) a piece of a toy or article that breaks off during testing that simulates use or abuse by children. If a "small part" fits completely into the specially designed test cylinder, and the toy or product from which it came is intended for use by children under three years of age, the toy or product is banned because the small part presents a choking hazard.

Thus, toys and products intended for use by children less than three years of age must not release pieces that fit completely into the small parts cylinder after impact, flexure, torque, tension and compression testing. These tests simulate the forces that toys and products can/may experience during normal use and abuse by children less than three years of age. If these forces cause parts to break off that fit in the small parts cylinder, those parts are deemed to present a risk of choking, aspiration, or ingestion to children less than three years of age.

Figure 8:
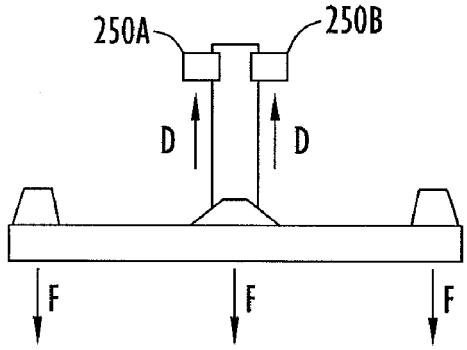
FIG. 8 illustrates a side perspective view of a key/plug in accordance with the present invention, indicating the application of shear forces thereon.

For this reason, the fingers 250A, 250B of the plug 110A-C are configured to plastically deform when a pressure of at least about 48-56 lbs. is applied to the plug 110A-C. That is, referring to FIG. 8, the fingers 250A, 250B of the plug 110A-C are resilient, thus they tend to flex whenever a downward force is applied to the plug 110A-C (as indicated by arrows F). As a result, should the plug 110A-C be oriented in its locked position when a user attempts to draw the plug out of the keyhole 430 with a force of at least about 48-56 lbs., the fingers 250A, 250B will plastically deform upward (in a direction D which is opposite to the force F) and remain intact (i.e., the fingers 250A, 250B plastically deform to permit removal of the plug 110A-C from the keyhole 430, but do not do not break off of the shaft 210), preventing the potential for formation of small parts as explained above. Many different materials may be utilized to form the shaft 210 and the fingers 250A, 250B of the plug 110A-C, such as different kinds of plastic and thermoplastics (such as ABS (acrylonitrile butadiene styrene), PPR (polypropylene resin), styrene, nylon, etc.). However in one preferred embodiment, the shaft 210 and the fingers 250A, 250B of the plug 110A-C are formed from PPR and shaped such that when a user attempts to draw a locked plug 110A-C out of the keyhole 430 with a force of at least about 48-56 lbs., the fingers 250A, 250B will plastically deform upward (in a direction D which is opposite to the force F) and remain intact.

While the invention has been described in detail and with reference to specific embodiments thereof, it will be apparent to one skilled in the art that various changes and modifications can be made therein without departing from the spirit and scope thereof. For example the base 200 may possess any shape and have any suitable dimensions. Though a generally circular, disc-shaped base 200 is illustrated, other shapes may be utilized, including but not limited to polygons. The biasing members 270A, 270B may be any suitable for their described purpose. The support platform 120 may be formed of any suitable materials, possess any suitable dimensions, and have any suitable shape. Similarly, the port 330 and the guide tracks 340A, 340B may possess any shape of have any dimensions suitable for their described purposed. For example, while a guide track is shown in the figures to be an opening (a pass-through), a guide track may also be defined by a recessed area or notch formed into the support platform 120. The pedestal 440 may possess any suitable shape and have any suitable dimensions. Specifically, the height of the pedestal 440 may be any suitable for its described purpose.

Thus, it is intended that the present invention cover the modifications and variations of this invention that come within the scope of the appended claims and their equivalents. It is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. A package assembly comprising:
- a support platform including:
  - a first surface,
  - a second surface, and
  - a pass-through extending from the first surface to the second surface;
- an object disposed on the support platform, wherein the object includes a keyhole aligned with the pass-through; and
- a key configured to be inserted into the pass-through and received by the keyhole, the key comprising:
  - a base including an integrally-formed biasing member, and
  - a shaft extending distally from the base, wherein the shaft includes:
    - a distal end,
    - a proximal end, and
    - at least one prong extending transversely from the shaft,
- wherein the integrally-formed biasing member is operable to generate a biasing force that biases the at least one prong against the object thereby securing the object to the support platform, and wherein the support platform further includes a guide track operable to receive the biasing member and to indicate that the at least one prong is oriented in a predetermined position within the object.

2. The package assembly of claim 1, wherein the biasing member applies a force in a direction that is parallel to the shaft.

3. The package assembly of claim 1, wherein the biasing member comprises an integrally-formed spring.

4. The package assembly of claim 3, wherein the spring comprises a generally arcuate spring.

5. The package assembly of claim 1, wherein the base further comprises a gripping member to permit manipulation of the key.

6. The package assembly of claim 5, wherein the gripping member comprises a cut-out section formed into the base of the key.

7. The package assembly of claim 1, wherein:
- the object is disposed on the first surface of the support platform;
- the key is axially inserted into the pass-through and the keyhole; and
- the at least one prong of the key is oriented such that it is misaligned with the keyhole thereby locking the object to the support platform.

8. The package assembly of claim 7, wherein the biasing member engages the second surface of the support platform to apply a force sufficient to draw the at least one prong into mechanical contact with the object, and to draw the object toward the base of the key.

9. The package assembly of claim 7, wherein:
- the object includes a wall and an interior pedestal extending distally from the wall;
- the pedestal defining a recess along an exterior portion of the wall; and
- the keyhole is disposed along a distal end of the pedestal.

10. The package assembly of claim 1, wherein:
- the object further comprises:
  - an interior surface;
  - an exterior surface; and a guide tab formed on the interior surface of the object and disposed proximate the keyhole, the guide tab being configured to be engaged by the at least one prong thereby preventing the rotation of the key beyond a predetermined rotational position.

11. The package assembly of claim 1, wherein the keyhole comprises an elongated slot.

12. The package assembly of claim 1, wherein:

the key selectively rotates from an unlocked position, in which the at least one prong aligns with the keyhole and is permitted to pass therethrough, to a locked position, in which the at least one prong is misaligned with the keyhole and is not permitted to pass therethrough; and the at least one prong is configured to deform but remain attached to the shaft when a force of at least 48 pounds is applied to the key to pull the key from its locked position, thereby permitting the removal of the key without separating the at least one prong from the shaft.

13. The package assembly of claim 12, wherein the at least one prong is formed from a polypropylene resin.

14. The package assembly of claim 1, wherein the key is selectively rotatable from a first rotational position, in which the at least one prong is aligned with the keyhole and the distal end of the shaft is permitted to pass through the keyhole, to a second rotational position, in which the at least one prong is misaligned with the keyhole and the distal end of the shaft is not permitted to pass through the keyhole.

15. The package assembly of claim 14, wherein the support platform includes a receptacle configured to receive the biasing member when the base is oriented in one of the first rotational position and the second rotational position.

16. The package assembly of claim 15, wherein the at least one prong comprises a first prong and a second prong diametrically opposed from the first prong.

17. The package assembly of claim 14, wherein the object comprises an alignment tab that selectively prevents the rotation of the key beyond a predetermined degree of rotation when the key is inserted into the object.

18. The package assembly of claim 1, wherein:

the object comprises an interior surface and an exterior surface;

the object is disposed on the first surface of the support platform;

the key is positioned such that the shaft is axially inserted into the pass-through and the keyhole and that the base is disposed on the second surface of the support platform;

the key is selectively rotatable from a first rotational position, in which the at least one prong is aligned with the keyhole and the distal end of the shaft is permitted to pass through the keyhole, to a second rotational position, in which the at least one prong is misaligned with the keyhole and the distal end of the shaft is not permitted to pass through the keyhole;

the biasing member urges the base away from the second surface of the support platform and draws the at least one prong into contact with the object interior surface when the key is oriented in the second rotational position; and the interior surface of the object comprises an alignment tab that selectively prevents the rotation of the key beyond a predetermined degree of rotation when the key is inserted into the object.

19. A package assembly comprising:

a support platform including a pass-through opening;

an object disposed on the support platform, the object including a keyhole; and a key configured to be inserted into the pass-through opening and received by the keyhole, the key comprising:

a base including a biasing member, a shaft extending distally from the base, and a prong extending transversely from the shaft, wherein the biasing member is operable to generate a biasing force that biases the at least one prong against the object thereby securing the object to the support platform, and wherein the support platform further includes a guide track operable to receive the biasing member.

20. A package assembly comprising:

a support platform including a first surface, a second surface, and a pass-through opening extending from the first surface to the second surface;

an object disposed on the support platform, wherein the object includes a keyhole; and a key comprising:

a base including an integrally-formed biasing member to engage the support platform, a shaft extending distally from the base, and a prong extending transversely from the shaft, wherein the key is inserted into the pass-through opening and received by the keyhole to position the prong within the object, and wherein the support platform further includes a guide track operable to receive the biasing member and to indicate the prong is oriented in a predetermined position within the object.

* * * * *